United States Patent [19]

Parrott

[11] 4,435,018

[45] Mar. 6, 1984

[54] MINERAL WINNING MACHINE FOR "IN WEB" MINING SYSTEM

[75] Inventor: George A. Parrott, Wakefield, England

[73] Assignee: Dresser Europe S.A.

[21] Appl. No.: 292,532

[22] Filed: Aug. 13, 1981

[30] Foreign Application Priority Data

Aug. 13, 1980 [GB] United Kingdom ..... 8026378

[51] Int. Cl.[3] ..... E21C 29/22

[52] U.S. Cl. ..... 299/43; 299/51

[58] Field of Search ..... 299/45–48, 299/43

[56] References Cited

U.S. PATENT DOCUMENTS

| | | | |
|---|---|---|---|
| 3,314,723 | 4/1967 | Mennekes | 299/43 |
| 3,711,160 | 1/1973 | Mennekes et al. | 299/43 |
| 3,753,595 | 8/1973 | Lanfermann | 299/43 |
| 4,054,321 | 10/1977 | Jarvis | 299/43 |

*Primary Examiner*—Ernest R. Purser

*Attorney, Agent, or Firm*—King and Liles

[57] ABSTRACT

An "in-web" mineral winning machine 1 for reciprocation along a mineral face, comprises an elongate machine body 2, adapted, in use, to be located beyond the face side sidewall 14 of an armoured conveyor 16 extending along the mineral face, at least one bridge 10 extending rearwardly from the machine body 2 and adapted, in use, to overlie the conveyor 16 and to engage slidingly a trapping means 19, 20, 21 located at the goaf side 15 of the conveyor 16, the or each bridge 10 housing a machine haulage unit 34, and the or each bridge 10 being connected to the machine body 2 by at least one joint 9 providing for articulation along an axis 11 extending parallel to the longitudinal axis of the machine body 2.

12 Claims, 5 Drawing Figures

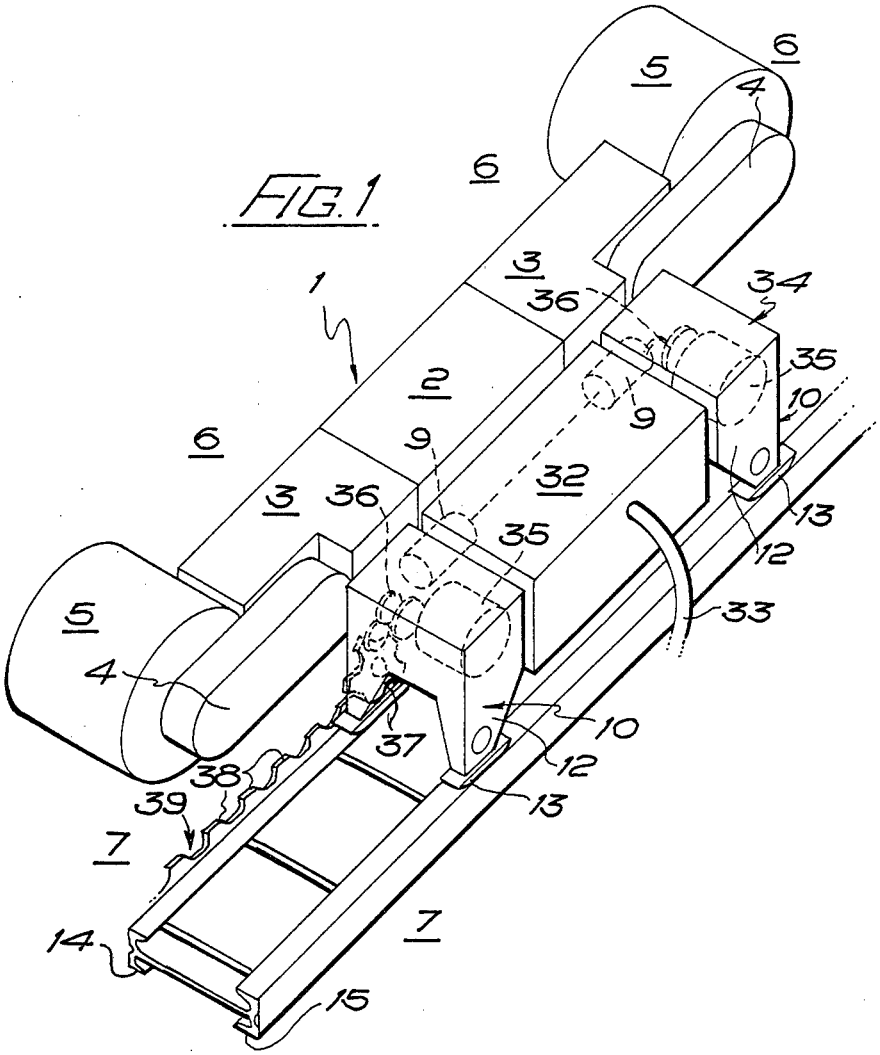
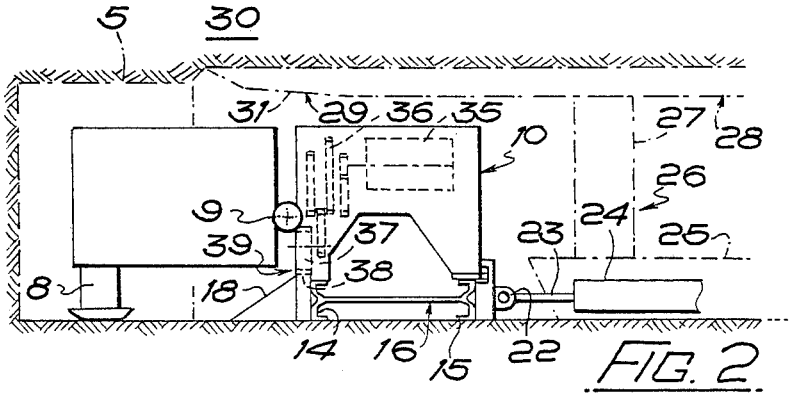
FIG. 2

MINERAL WINNING MACHINE FOR "IN WEB" MINING SYSTEM

This invention relates to an "in-web" mineral winning machine and to a mineral winning system incorporating such a machine. In the longwall mining of coal and other minerals, a mineral winning machine is reciprocated along a mineral face to extract mineral from the seam, the mineral being loaded onto an armoured, scraper chain conveyor extending along the mineral face, which conveyor serves to guide the machine along the face. Extraction is usually effected by a rotary, pick-carrying cutting head mounted at one end of a ranging arm pivotally attached to the machine body, which arm is displaceable under the control of a double-acting hydraulic ram. If, as is usually the case, the machine is designed as a double-ended machine, one cutting head and arm are capable of being mounted at each end of the machine. With relatively thick mineral seams, the machines are usually mounted on the conveyor in addition to being guided thereby, but the present invention is concerned with the winning of medium/thin seams, e.g. 6 ft. or less where the main body of the machine is positioned beyond the face side sidewall of the conveyor and slidingly engages the conveyor at various locations for guidance purposes. Such machines are double-ended and are known as "in-web" machines, and roll steering of these machines is effected by a pair of vertical rams, one located towards each end of the machine and each carrying a shoe to bear on, and slide along, the mine floor located beyond the face side sidewall and just cut by the leading drum.

In recent years there has been a requirement for the adoption of so called "chainless" machine haulage systems which operates on the rack and pinion principle. The racks are attached to the conveyor, normally at the goaf side thereof. However, for "in-web" machines, this location is too distant from the machine body for satisfactory haulage and face side location of the racks is known. The racks are engaged by at least one drive sprocket or endless drive chain carried by the machine and trapped into rack engagement, with alternative or additional machine guidance/trapping being effected by a bridge extending from the machine body over the conveyor to engage slidingly trapping means carried by the goaf side of the conveyor. However, to enable the roll steering functions of the machine to be attained, a greater degree of play than would normally be provided is required in the trapping of the drive sprocket(s) or endless drive chain(s) in the rack, so that the machine can articulate with respect to the conveyor, but the increased play to achieve roll steering adversely affects satisfactory engagement of the drive sprocket(s) or drive chain(s) with the rack. An additional problem is that when the machine body is lowered by the roll steering ram(s), with respect to the conveyor, the end of the bridge remote from the machine is correspondingly raised. As "in-web" machines are used only in medium/thin mineral seams, the result is that the elevated end of the bridge often fouls the undersides of roof beams extending in cantilever fashion from the self-advancing, hydraulically-powered roof supports conventionally provided along the goaf side sidewall of the conveyor. It is also the case that the bridge is a largely unused area serving usually to house only electric/electronic/hydraulic controls for the various functions of the machine and the overall length of the machine, which advantageously should be the minimum possible for the limited confines available underground, remains of generally conventional dimensions. Additionally, both ends of an armoured, scraper chain conveyor are unavoidably elevated, the elevation at the drive head being gradual, which elevation ultimately prevents further travel of the machine towards the drive head. The result is that at the drive head, the distance between the leading end of the bridge and the length of the adjacent ranging arm is critical and normally needs to be such that the cutting head on that arm can cut slightly beyond the drive head so as to cut a clearance space to accommodate the drive head when the latter is advanced. With some installations, this cannot be achieved and the clearance must be completed manually.

According to a first aspect of the present invention, an "in-web" mineral winning machine for reciprocation along a mineral face, comprises an elongate machine body adapted, in use, to be located beyond the face side sidewall of an armoured conveyor extending along the mineral face, at leaast one bridge extending rearwardly from the machine body and adapted, in use, to overlie the conveyor and to engage slidingly a trapping means located at the goaf side of the conveyor, the or each bridge housing a machine haulage unit, and the or each bridge being connected to the machine body by at least one joint providing for articulation along an axis extending parallel to the longitudinal axis of the machine body.

According to a second aspect of the present invention, a mineral winning system comprises at least one mineral winning machine as defined above, an armoured scraper chain conveyor extending along a mineral face and a rack extending along the conveyor and attached to a sidewall thereof, the rack being engaged by the or each machine haulage unit.

Thus, by adopting the machine and system in accordance with the invention, the movements in use, of the machine body with respect to the conveyor as a result of roll steering requirements do not result in consequential movements of the or each bridge because of the presence of the articulated joint(s). It follows therefore that because no consequential movement of the bridge(s) occurs upon roll steering of the machine body, firstly the bridge(s) can always maintain an optimum position with respect to the rack for the transmission of haulage forces and secondly, the end of the bridge(s) remote from the machine body is always spaced by generally the same distance from the undersides of roof bars of roof supports. Furthermore, the location of at least one haulage unit within the bridge means that a haulage module can be eliminated from the machine body, as a result of which the overall length of the machine body can be correspondingly reduced and the attendant advantages obtained.

The rack may be attached to the face side sidewall or the goaf side sidewall of the conveyor. Preferably, the machine is double-ended comprising a ranging arm pivotally attached to each end of the machine, each arm being under the control of a double-acting hydraulic ram, and each arm rotatably carrying a rotary, pick-carrying cutting head. Two individual and longitudinally spaced apart bridges may be provided, each connected by a pair of hinge joints to the machine body and each housing a haulage unit. The latter may comprise a drive sprocket drivable either by a hydraulic motor and gearbox, or by an electric, variable speed motor. With a hydraulic drive, the machine body may house a hydraulic pump. Furthermore, the hinge joints at two individual bridges ensure that two independently movable haulage units may be provided, both slidably trapped at the goaf side with movements of one unit to retain an optimum rack engagement position not affecting the disposition of the other unit. Preferably, the two bridges are spanned by an articulated tray which conveniently is employed to carry and/or house electric/electronic/-hydraulic control means for the various functions of the machine.

A further significant advantage can be obtained if in accordance with another preferred feature, the articulated joint is associated with slide means, with at least one double-acting hydraulic ram arranged along the longitudinal axes of the machine body and connected between the bridge(s) and the machine body, whereby the machine can be displaced longitudinally with respect to the bridge(s). This means that at a drive head, the arm length/leading bridge end distance is no longer critical, for the bridge(s) can be halted when no further movement thereof towards the end of the conveyor is possible (due to the conveyor gradually elevating towards the drive sprocket) but the machine body and hence cutting head can continue to be advanced to cut the required clearance by actuating the hydraulic ram(s). If two individual bridges are provided one bridge only e.g. that adjacent the main gate or roadway may be provided with slide means, whereby that bridge may be retracted or conversely the machine body advanced with respect to that bridge, in the vicinity of the conveyor drive head. Furthermore, should the elements incorporated in the machine body e.g. electric motors, pump units, or alternatively the or each haulage unit, develop a fault, the machine body can be readily detached from the bridge(s) by ensuring that the machine body remains stationary and the bridge(s) is displaced (by providing an auxiliary fluid or electric supply). Thus, if a fault occurs in the machine body, removal of the bridge(s) gives ready access to the machine body. Alternatively, if a fault occurs in a haulage unit the bridge(s) can be displaced to a more convenient location for repair/overhaul, and/or so that a replacement bridge(s) can be brought into use and connected to the fault free machine body, to result in a minimum loss of production. As the tail end of the conveyor is also elevated, but not in the gradual manner needed at the head end, it may in certain circumstances be advantageous to operate the machine in an asymmetrical configuration with the slide ram activated to place the bridge(s) nearer to one end of the machine than the other.

The invention will now be described in greater detail, by way of examples, with reference to the accompanying drawings in which:

FIG. 1 is a perspective view, looking from goaf to face, of a first embodiment of mineral winning machine and system in accordance with the invention.

FIG. 2 is a part sectional end elevation of FIG. 1; and

Figure 3:
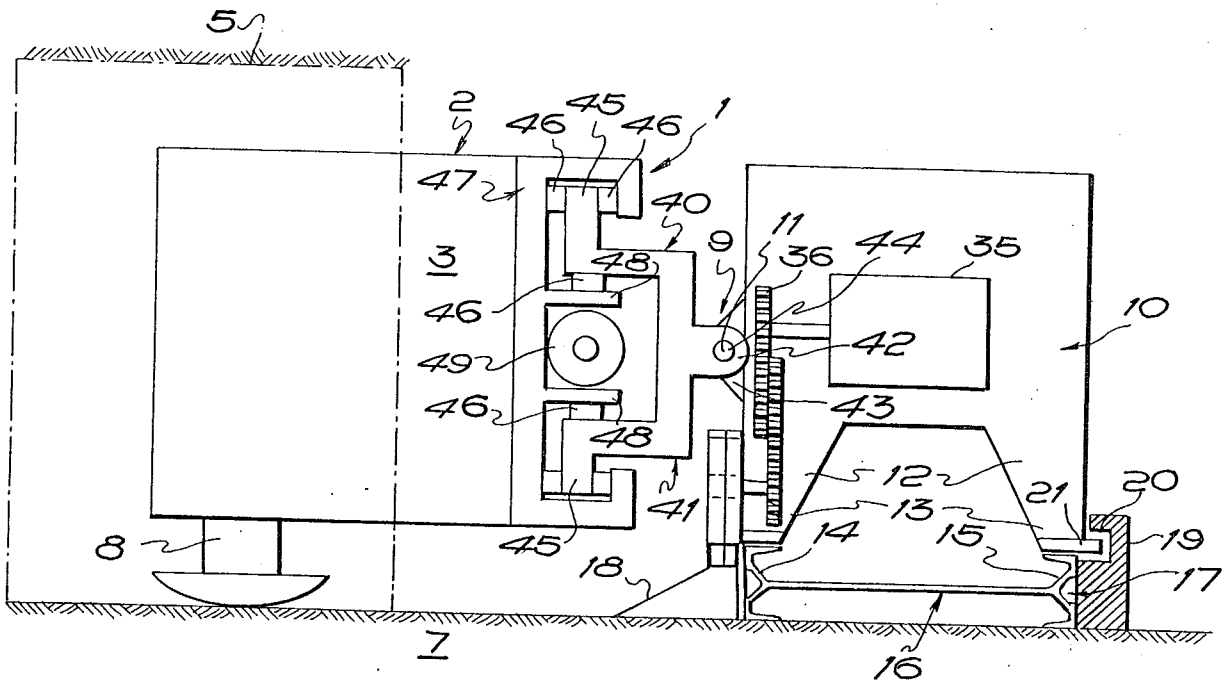
Figure 4:
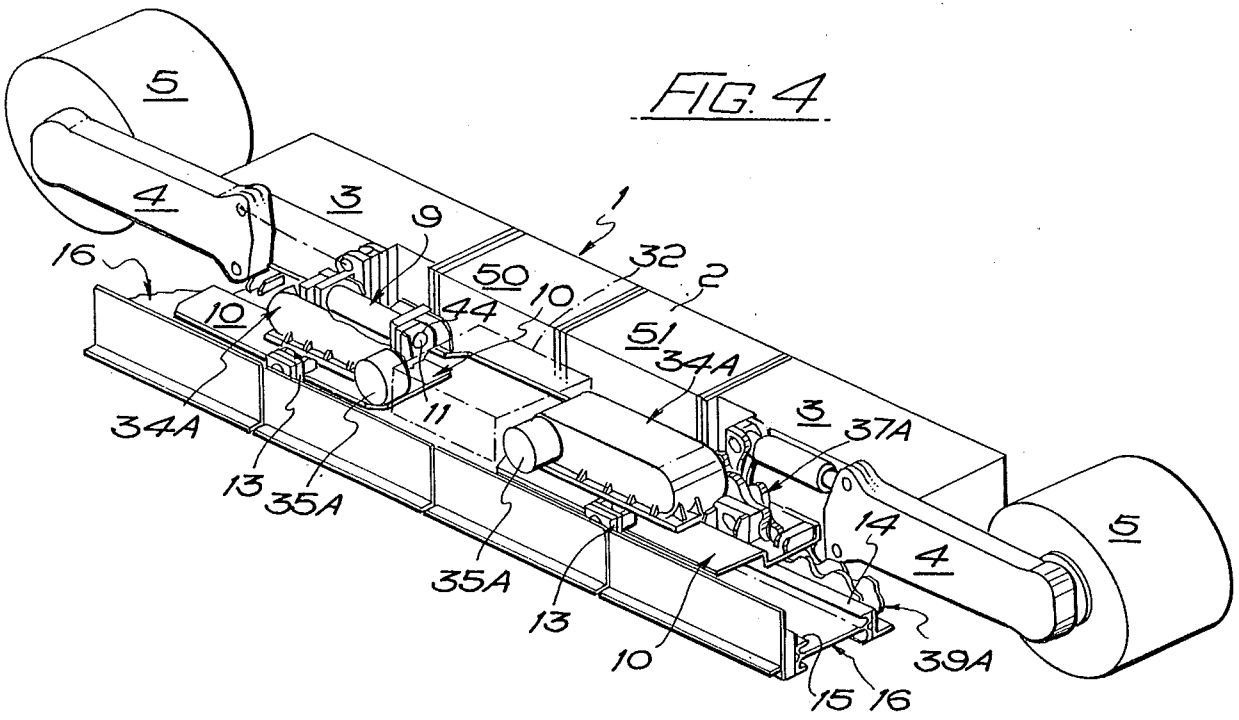
Figure 5:
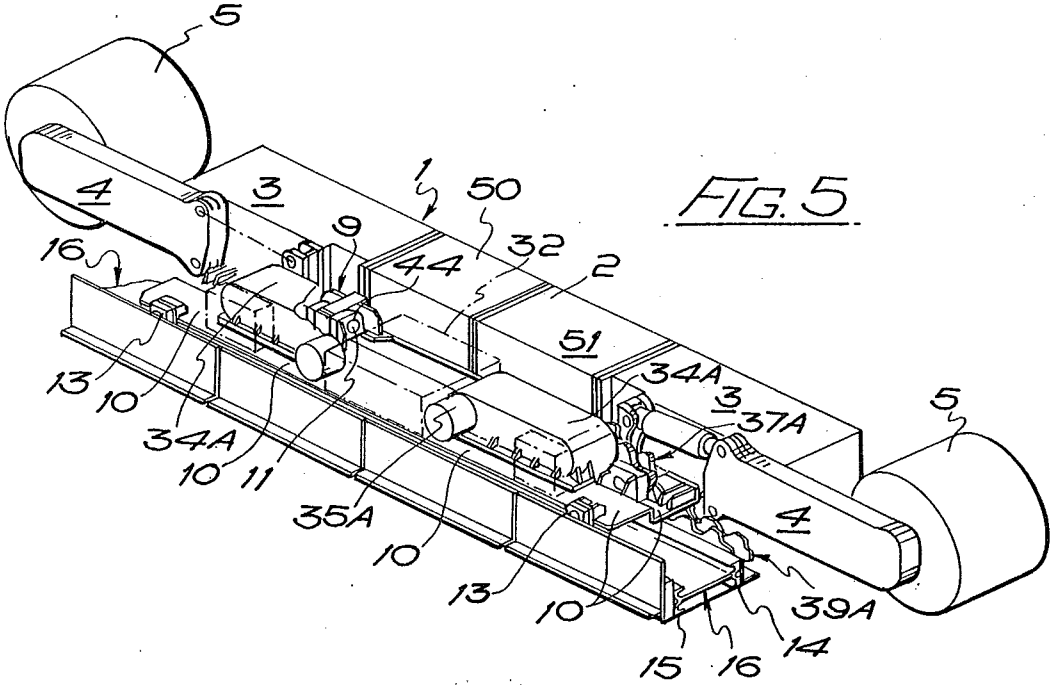

FIG. 3 corresponds to FIG. 2 but shows a second embodiment;

FIG. 4 is a perspective view, similar to FIG. 1, but showing a fourth embodiment; and FIG. 5 corresponds to FIG. 4 but shows a fifth embodiment.

In all the drawings, like reference numerals are employed for like components.

In the drawings, an "in-web" mineral winning machine 1 of the shearer type comprises an elongate machine body 2 housing a main electric motor to supply power to gearheads 3 located at each end of the body 2, each gearhead supporting a ranging arm 4 which is pivotable with respect to its gearhead 3, in the known manner, under the control of a double-acting hydraulic ram (not shown). Each ranging arm 4 houses gearing to transmit drive to a rotary, pick carrying cutting head 5 carried at the free end of the arm to remove mineral from a face 6. As can be seen from FIG. 2, the machine seats on mine floor 7 via steering rams 8, one of which is located towards each end of the machine body 2.

The machine body 2 is attached by hinge joints 9 to two longitudinally spaced apart bridges 10, the joints 9 providing for articulation of the machine body 2, with respect to the bridges 10, about an axis 11 parallel to the longitudinal axis of the machine body 2.

Each bridge 10 incorporates a pair of downwardly depending legs 12 each terminating in a slide shoe 13 one slidably engaging a face side sidewall 14, and the other slidably engaging a goaf side sidewall 15 of a pan 16 of an armoured scraper conveyor 17 extending along the face 6. The face side sidewall 14 is additionally provided with a ramp plate 18 to assist loading of mineral cut by the heads 5 onto the conveyor 17, while the goaf side sidewall 15 is provided with a trapping rail 19 having a recess 20 for sliding engagement by a tongue 21 of each slide shoe 13. The goaf side sidewall 15 is also provided with a clevis rail 22 to which is attached a piston 23 of an advancing ram 24 located within a base means 25 of a hydraulically powered self-advancing mine roof support 26 comprising a plurality of hydraulically extensible chock legs 27 attached at their lower ends to the base means 25 and at their upper ends to a roof beam 28 comprising a cantilever extension 29 and in engagement with a mine roof 30. The extension 29 overlies at least the bridges 10 and has an underside 31 adjacent the bridges 10.

The bridges 10 are spanned by an articulated tray 32 which is employed to carry and/or house electric/electronic control means for the various functions of the machine, electrical energy for the main electric motor housed within the machine body 2 being supplied along a flexible cable 33. Each bridge 10 houses a machine haulage unit 34 comprising a variable speed electric motor 35, a speed reduction transmission 36 and a haulage sprocket 37 drivably in mesh with teeth 38 provided on a rack 39 made up of a plurality of individual rack bars corresponding in length to that of an individual pan 16.

It will be appreciated, that by provision of the joints 9, the machine body 2 can be roll steered, i.e. moved upwardly or downwardly with respect to the bridges 10, by means of the rams 8, in order to follow accurately the mineral seam being extracted and/or because of mine floor conditions, and movements of the machine body 2 in no way affects the position of the bridges 10 and their haulage sprockets 37 with respect to the teeth 38 of the rack so that these drive elements remain in their optimum drive transmitting positions.

In the embodiment of FIG. 3, there is provided a slide means 40 interposed between the machine body 2 and the bridges 10. The slide means 40 comprises a first member 41 provided with an apertured lug 42 which aligned with an apertured lug 43 of each bridge 10 to receive a common hinge pin 44. Remote from the latter the first member 42 terminates in a pair of mutually opposed tongues 45 engaging through six bearings elements 46 a second member 47 of the slide means 40, the member 47 having a profile suitable to receive the tongues 45 and bearing elements 46 and incorporating a pair of central ribs 48 between which is located a double-acting hydraulic piston and cylinder unit 39, the piston thereof being connected to the machine body 2 and the cylinder thereof to one of the first members. Thus, when a drive head of the conveyor 16 is reached by one or other of the bridges 10, which drive head is necessarily elevated with respect to the mine floor 7 so that it may incorporate the necessary drive (or return) sprocket, then by actuation of the piston and cylinder unit 49, the machine body 2 may be displaced with respect to the stationary bridges 10 whereby the arm 4 and cutting head 5 adjacent the conveyor drive head in question may be advanced past that drive head so that for instance the cutting head 5 may cut clearance for subsequent advance of that drive head. Also in FIG. 3 is indicated a twin haulage sprocket 37A in engagement with a twin, and staggered, tooth rack 39A.

In the embodiment of FIG. 4, the machine again employs a twin haulage sprocket 37A at each of its haulage units 34A, the sprockets 37A drivably engaging a twin, and staggered tooth rack 39A. The machine body 2 is also indicated as comprising a pump box 50 and a housing 51 for a main electric motor to power the rotary cutting heads 5. In detail, the haulage units 34A are separate self-contained modules seated on top of individual bridges 10, each unit 34 comprising, in contrast to the previous embodiments, a hydraulic motor 35A.

The embodiment of FIG. 5 is very similar to that of FIG. 4 except that a single bridge 10 is provided, which carries both haulage units 34A.

What I claim is:

1. An "in-web" mineral winning machine for reciprocation along a mineral face, comprising an elongate machine body adapted, in use, to be located beyond a face side sidewall of an armoured conveyor extending in a predetermined direction along a mineral face, said machine body having a longitudinal axis extending in the predetermined direction, said conveyor also having a goaf side sidewall, a pick-carrying rotating cutting head carried by said machine body and rotatable about an axis extending transverse to the longitudinal axis of the machine body, power means housed within said machine body for rotating said pick-carrying cutting head, at least one bridge extending rearwardly from said machine body and adapted, in use, to overlie said conveyor, a trapping means located at said goaf side of said conveyor and being slidingly engaged by said at least one bridge, a machine haulage unit associated with said at least one bridge, and said at least one bridge being connected to said machine body by at least one joint providing for articulation of the machine body relative to said at least one bridge along an axis extending parallel to the longitudinal axis of said machine body.

2. A machine as claimed in claim 1, comprising a ranging arm pivotally attached to each end of said machine body, a double-acting hydraulic ram controlling each said arm, and a rotary, pick-carrying cutting head carried by each said arm.

3. A machine as claimed in claim 1 comprising two individual and longitudinally spaced apart bridges, each said bridge connected by a pair of hinge joints to said machine body and each said bridge housing one of said machine haulage units.

4. A machine as claimed in claim 3, wherein each said machine haulage unit comprises a drive sprocket drivable by a hydraulic motor and gearbox.

5. A machine as claimed in claim 4, wherein said machine body houses a hydraulic pump.

6. A machine as claimed in claim 3, wherein each said machine haulage unit comprises a drive sprocket drivable by an electric, variable speed motor.

7. A machine as claimed in claim 3, wherein an articulated tray spans said two bridges.

8. A machine as claimed in claim 7, wherein said tray carries and/or houses electric/electronic/hydraulic control means for the various functions of said machine.

9. A machine as claimed in claim 1, wherein slide means is associated with said articulated joint, with at least one double-acting hydraulic ram arranged along said longitudinal axis of said machine body and connected between said bridge(s) and said machine body, whereby said machine body is displaceable longitudinally with respect to said bridge(s).

10. A machine as claimed in claim 9 comprising two individual and longitudinally spaced apart bridges, with said slide means provided at one only of said bridges.

11. A mineral winning system comprising a machine as claimed in claim 1, an armoured scraper chain conveyor extending along a mineral face and a rack extending along said conveyor and attached to a sidewall thereof, said rack being engaged by the or each machine haulage unit.

12. A mineral winning system as claimed in claim 11, wherein the rack is attached to the face side sidewall.

* * * * *